United States Patent [19]

Hays

[11] Patent Number: 4,627,958

[45] Date of Patent: Dec. 9, 1986

[54] DENSIFICATION OF METAL POWDER TO PRODUCE CLADDING OF VALVE INTERIORS BY ISODYNAMIC COMPRESSION

[75] Inventor: Charles Hays, Pearland, Tex.

[73] Assignee: Gray Tool Company, Houston, Tex.

[21] Appl. No.: 565,434

[22] Filed: Dec. 27, 1983

[51] Int. Cl.[4] ..... B22F 7/00

[52] U.S. Cl. ..... 419/8; 29/156.7 R; 29/157.1 R; 29/DIG. 31; 251/366; 251/367; 251/368; 419/48; 419/49; 427/181; 427/239

[58] Field of Search ..... 419/8, 48, 49; 29/156.7 R, 157.1 R, DIG. 31; 251/366, 367, 368; 427/239, 181

[56] References Cited

U.S. PATENT DOCUMENTS

| | | | |
|---|---|---|---|
| 1,896,939 | 2/1933 | Calkins et al. | 419/8 |
| 2,331,584 | 10/1943 | Underwood | 419/8 |
| 4,065,302 | 12/1977 | Turillon | 419/8 |
| 4,477,955 | 10/1984 | Becker et al. | 419/8 |
| 4,562,090 | 12/1985 | Dickson | 427/34 |

OTHER PUBLICATIONS

Kelsey–Hayes Powder Technology Center, dated 1982 "Rapid Omnidirectional Compaction (ROC).

*Primary Examiner*—Stephen J. Lechert, Jr.

[57] ABSTRACT

A valve cladding method and associated system for implementation including the steps of preforming solid insert-members (22,24) of a vitreous material (having a rheological state that varys with temperature), to generally conform in shape to the cavity walls (12, 14) that are to be clad. The insert-member is fixtured (32) within the cavity to provide a generally concentric, annular space (28) of predetermined thickness and length between the insert-member and the adjacent walls to be clad, thereby defining an activation volume. This volume (28) is filled with loose metal powder (48) and vibrated to achieve tap density for a given powder blend. The activation volume is degassed, evacuated and sealed. The valve body (10') a thus loaded, is heated to a temperature at which the insert members becomes pliable, in the range from one-half to full melting temperature of the powder. Pressurization of the heated article is achieved by the use of a suitable press (50, 62) mechanical or hydraulic, with adequate configured, mated dies (52, 58). The heated valve body is placed within dies appropriate for applying a pressure-ramp-cycle to the pliable insert-members, sufficient for the insert to hydrodynamically transmit the applied pressure-pulse to the activation volume, whereby the metal powder is isodynamically compacted and metallurgically bonded to the adjacent cavity walls. After cooling in normalized fashion, the insert-member material reverts to its brittle, glass-like behavioral patterns that exist at room temperature and this reversion from pliable-to-brittle properties allows easy extraction of the insert-members.

14 Claims, 8 Drawing Figures

DENSIFICATION OF METAL POWDER TO PRODUCE CLADDING OF VALVE INTERIORS BY ISODYNAMIC COMPRESSION

FIELD OF INVENTION

The present invention relates to the production of alloy cladding on the interior surfaces of complex geometries such as valve bodies, by the densification of metal powder.

BACKGROUND OF THE INVENTION

The benefits associated with composite structures for use in oilfield equipment, particularly that for wellhead equipment, are well known and documented. Effluent-wetted surfaces of petroleum or petrochemical processing equipment are clad to improve corrosion, heat or wear resistance; to withstand errosion, high pressure or applied stresses; to rebuild worn or improperly sized parts; or to retro-fit old machinery for modern performance standards. Typical clad coatings for oilfield applications include austenitic stainless steels, Fe-base nickel alloys or nickel-base compositions.

There exists a strong economic incentive for cladding a given part rather than making it entirely from corrosion-resistant-alloy (CRA) material for two important reasons; (1) In this specialized industry, massive section-sizes are used and (2) Significantly different material costs do exist for a substrate of low-alloy carbon-steel and a cladding of CRA material. Generally, when a surface coating exceeds about 3% of the total mass of the base, or substrate material, the resultant product shape is called a composite structure and the coating is considered as a cladding.

Typical clad coatings for wellhead equipment are fabricated by either welding or hot-isostatic-pressing (HIP) techniques. Experience with these conventional technologies has shown that a number of problems still exist, including those associated with interfacial delaminations, low bond strengths, significant porosity levels, escessive defects or discontinuities, capital or labor intensive costs, dilution, precipitation hardening and residual stresses.

Diffusion couples resulting from the HIP process can cause extreme segragation and undesired concentration gradients across the interfaces between the can used for containing the loose powder prior to densification and the consolidated clad deposit. A similar problem of undesired diffusion zones can also develop at the clad interface with respect to the underlying substrate material. Weld-deposited clad exhibits less segregation and fewer concentration gradients than HIP-clad structures but welding introduces another disadvantage in the form of a quenched-and-tempered martensitic phase structure at the interface of clad and substrate material.

SUMMARY OF THE INVENTION

The present invention is an improved process and system for making better composite steel structures with cladding for superior product integrity, at a labor cost significantly less than that associated with weld-clad and required capital cost significantly less than that associated with HIP clad.

The composite steel structures fabricated in accordance with the invention can be made to exhibit strong metallurgical bonding, negligible porosity, defects or discontinuities of a sub-critical size, shape and distribution, minimum dilution, no aging effects and, with a hot-finished condition, low residual stresses.

The improved method includes the steps of preforming solid insert-members of a vitreous material (having a rheological state that varys with temperature), to generally conform in shape to the cavity walls that are to be clad. The insert member is fixtured within the cavity to provide a generally concentric, annular space of predetermined thickness and length between the insert-member and the adjacent walls to be clad, thereby defining an activation volume. This volume is filled with loose metal powder and vibrated to tap density for a given powder blend. The activation volume is degassed, evacuated and sealed. The article or valve as thus loaded, is heated to a temperature at which the solid metal powder undergoes self-diffusion for densifaction with suitable pressures that are transmitted through insert-members which have been softened, made pliable or become viscoelastic. A pressurization of the heated article is achieved by the use of a suitable press, mechanical or hydraulic, with configured, mated dies. The heated article is placed within dies appropriate for applying a pressure-ramp-cycle to pliable insert-members, sufficient for the insert-member to hydrodynamically transmit the applied pressure pulse to the activation volume, whereby the powder metal is isodynamically compacted and metallurgically bonded to the adjacent cavity walls. After the article is cooled innormalized fashion, the preferred insert material reverts to the brittle, glass-like behavioral patterns that exist at room temperature and this reversion from pliable to brittle properties allows an easy extraction of the pressure transfer-medium from complex geometries.

In summary, the improved process and system simplifies the internal cladding of complex equipment such as wellhead components. CRA claddings can be consolidated with a single stroke of a suitable press to cause isodynamic compaction and metallurgical bonding in a composited structure.

BRIEF DESCRIPTION OF THE DRAWINGS

The preferred embodiment of the invention, and the best mode for execution thereof, are described below with reference to the accompanying drawings, in which.

DESCRIPTION OF THE PREFERRED EMBODIMENT

As an example to fully disclose the best mode of practicing the preferred embodiment of the invention, the following description is directed to cladding the interior of a valve body of the type that is typically used in oilfield equipment applications.

Figure 1:
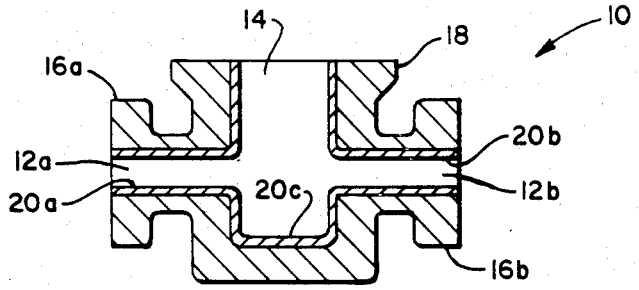
FIG. 1 is a schematic section view of a typical valve body showing a clad through-bore and a clad central-cavity.

FIG. 1 shows a cutaway view of a valve body 10 having interior cavities including bores 12*a*, 12*b* and a central cavity 14. The valve body 10 is fabricated, typically, from low-alloy carbon-steel forgings that include bore flanges 16*a*, 16*b* and a central flange 18. When specified for use in harsh environments of extreme pressure or corrosivity, such forged valves are modified, as by deposition of CRA cladding 20*a*, 20*b* in bores 12*a*, 12*b*, respectively. In most cases, the central-cavity-chamber 14 must also receives a CRA clad deposit 20*c*.

The initial step in the inventive method is to machine the low-allow steel carbon-steel valve body 10 to oversize dimensions for accommodation for enough metal powder so that the final interior sizes may be obtained after densification-to-clad and final-machining has occurred. The interior surfaces are then prepared in a manner that is well known by practitioners in the art; i.e., to remove surface debris and to develop a clean and dry metal surface for subsequent processing.

Figure 2:
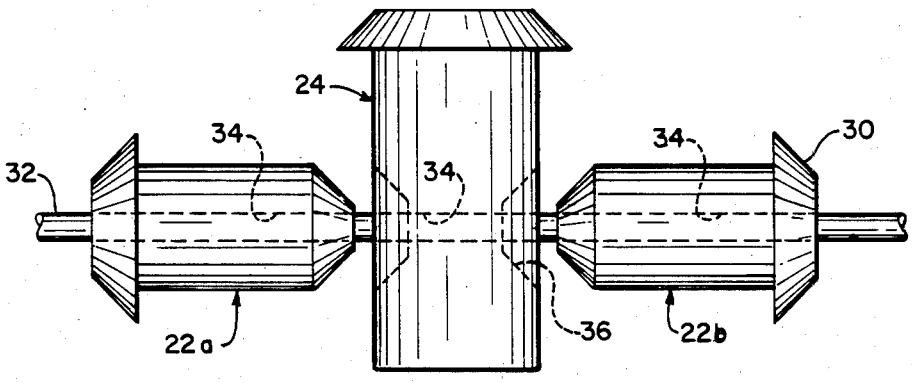
FIG. 2 is a schematic representation of a composite insert-member for placement in the bores and central cavity of a valve body of the type illustrated in FIG. 1, illustrating one way of fixturing the insert-member for proper alignment, engagement and location within the valve body interior.
Figure 3:
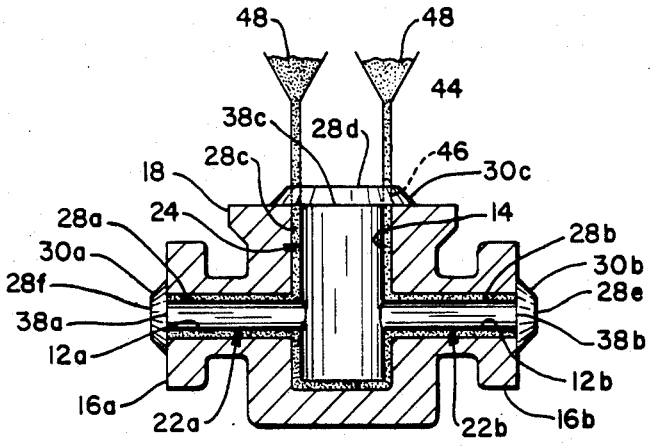
FIG. 3 is a sectioned view of a valve body of the type shown in FIG. 1, with bore and cavity insert-members fixtured therein to define an activation volume filled with metal powder for cladding the bore and cavity.

As shown schematically in FIGS. 2 and 3, ceramic-type-core insert-member components 22*a*, 22*b*, and 24 are precast using a vitreous material mixture to form a bulk shape that conforms to the mating cavity or bore wall 12*a*, 12*b*, 14 respectively. If bulk shape and size of the as-cast pressure-transfer-medium preforms is expected to cause a problem that involves shrinkage during compression, then the porous, as-cast preforms are hot-worked to close pores prior to their use as insert-members. This is to say that high density preforms can be used if shrinkage is considered to be a real problem.

The size of the bore inserts 22*a*, 22*b* and 24 is such that a concentric annular space 28 of predetermined distance between an insert-member such as 22*a* and the adjacent wall to be clad 12*a* is provided, when the insert-member 22*a* is properly aligned within the bore 12*a*. This annular space will be filled with metal powder as more fully set forth below. In the present example, the bores 12*a*, 12*b* and central chamber 14 will be clad.

The core insert-members are then centered and fixtured within the bores and central cavity, such that the thin metallic capstone 30 remains exposed, providing an external surface that is accessible from the environment of the article or valve body 10. The preferred fixturing includes a tensioner and alignment rod 32 that can slide through passageways 34 in the bore and csavity inserts 22, 24 respectively. The shaped ceramic-type-cores, which have been previously precast and cured or precast, cured and hot-worked are inserted into the valve body and adjustments are made with the alignment rod 32. The bore inserts 22*a*, 22*b* are mated to the cavity insert 24 by tapered slip joints 36 that were previously-wetted with uncured ceramic-sand-water slurry for adhesive purposes. Inserts are tensioned and allowed to cure and set under slight positive tension until acceptable adhesive bonding is achieved for the fayed surfaces of the slip joint 36.

Next, capstone metal plates 30*a*, 30*b* and 30*c* are seal-welded against the article or valve body flanges 16*a*, *b* and 18, respectively, to form a closed activation volume 28 that is defined by these limit boundaries for this embodiment: bores 12*a*, 12*b*; bore insert 22*a*, 22*b*; cavity 14 and cavity insert 24, and capstones 30*a*, *b*, *c*. The invention could be practiced using vitreous capstone heads that were form-fitted as integral flanges to the insert-members. In such embodiment, the capstone heads are mechanically-sealed to the article as a result of selective melting or 'sweating' certain sections of the vitreous-media-heads and permitting those outer solidification chill zones to form matching surface contours with its mold; in this case, the faying surfaces (flat-flange-regions) of the article flanges 16*a*, 16*b*, and 18.

Tubes 44 made from the insert material are placed within openings 46 in capstone 30*c*, and used to fill the activation volume 28 with the metal powder blend 48 to the tap density associated with the particular blend. In the preferred embodiment, the capstones provide ample volumetric reservoirs 28*d*, 28*e* and 28*f* to ensure the attainment of tap density by an appropriate migration of the high-alloy metal powder to all recesses of the activation volume. During this filling step, the valve body is mechanically vibrated to achieve maximum tap density, which is typically about 60% of theoretical density for a given powder composition. At this point, tensioner/alignment rods can be removed, if desired. Should rod extraction occur or if capstone heads are utilized, all leakage zones must be fully-sealed and leak tested before degassing is attempted.

Figure 4:
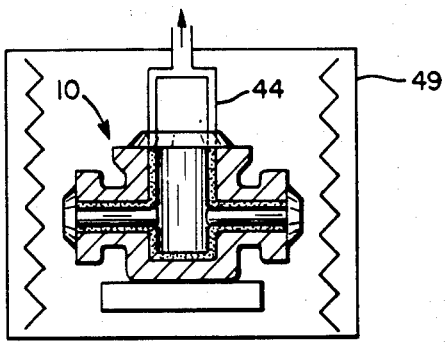
FIG. 4 is a schematic representation of the degasification and evacuation of the activation volume.

FIG. 4 schematically shows the valve body with CRA metal powder loaded therein, mounted in a cleaning and degassing apparatus 49 for the removal of excess moisture by evacuation at about one negative atmosphere and about 500° F. At an elevated temperature of about 1,000° F. and approximately 100 microns of vacuum pressure, degassing is applied to remove the air and any undesired purge gases that are entrapped in the activation volume; either on or between the powder particulates. This is done to promote diffusion bonding that occurs in the absence of oxygen to cause powder particulates to coagulate with temperature and time at a subsequent stage of processing. After the activation volume has been appropriately purged to remove undesired impurities, the fill tubes 44 are locally heated, collapsed and sealed. These steps in the methodology of filling, cleaning and sealing are standard procedures for vacuum technologists and, as such, additional detailed explanations are not deemed to be necessary.

It should be appreciated that, for any given metal powder, the dimensional variations associated with consolidation from tap density to final, near-theoretical density (spatial densification factor), are well documented or known. Accordingly, for a specific final clad bore specification, the initial inner diameter of bore 12*a*, and outer diameter of the insert 22*a*, will be uniquely specified by this spatial densification factor, the designed activation volume length and thickness parameters and the extent of machining a densified cladding for producing the specific final clad bore size. For example, spatial densification factors with nickel-base metal powder blends of platelet particles are generally about 64% for an original activation thickness of 0.375-inch that is subsequently consolidated to a full-density thickness that will ensure final machining to produce an overall minimum thickness of 0.125-inch for finished clad throughout an article bore interior of 2.563-inch nominal diameter.

A wide variety of metal powder blends and different particle shapes may be used to practice the present invention with the one provision that maximum tap density should be obtained during filling of the activation volume. Powder compositions, blends, particle shapes and mixturals are chosen primarily on the basis of structure and property characteristics that are required for the densified clad deposit; e.g., coefficients of thermal expansion for both clad and substrate are selectively chosen to ensure bimetallic compatibility in service without cracking or delamination problems. For any particular powder composition, blend, shape or mixtural, the densification parameters of consolidation temperature/pressure are either known, documented in the open literature or easily determined by experiment.

Figure 5:
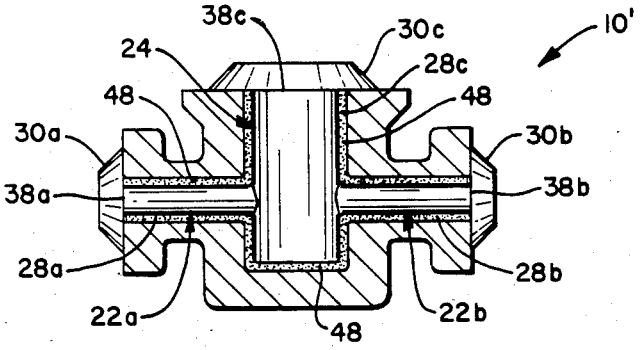
FIG. 5 is a schematic representation of a fully-loaded valve body where the activation volume has been filled with metal powder, shaken to its tap density, degassed, evacuated, and sealed, thus representing the condition associated with heating the loaded article prior to powder densification.

After the fill tubes have been sealed, the loaded article is now ready for the powder-to-clad densification step. "Loaded article" means, in the present context as shown in FIG. 5, that the valve interiors to be clad have inserts 22*a, b* and 24 fixtured therein, that the inserts and capstones 30 have been sealed to define an activation volume 28, and that the activation volume has been filled to maximum tap density with a powder blend 48, which has been cleaned, evacuated, and sealed. As a practical matter, it is preferable that all effluent-volumes (valve body cavities) contain sealed insert-members, whether for defining an activation volume or merely filling the void associated with surfaces that are not intended to receive cladding. In this way, uniform hydrostatic forces can more easily be applied throughout the interior of the valve body, leakage of insert material from the cavities to be clad can be avoided and manipulators or handling equipment are more easily deployed.

The next step is to heat the loaded article or valve body 10' to a temperature T within the range $0.5\ T_m < T < T_m$, where $T_m$ is the melting temperature (absolute) for the CRA powder composition, with the preferred process temperature being about $0.8\ T_m$. This process temperature of $0.8\ T_m$ causes self-diffusion of substitutional atoms in the atomic lattices of the powder alloy to support solid-state-diffusion between surfaces, areas and volumes for specific powder particulates. This process temperature also softens the metal powder 48 and causes the insert-members 22, 24 to achieve a pliable, viscoelastic rheological state that is conducive to the subsequent application of mechanical compression. The hot, loaded article 10', and particularly the exterior surfaces 38*a*, 38*b*, 38*c* of the insert-members, (and capstones 30) are then subjected to a substantially uniform pressure (i.e., a hydrostatic or hydrodynamic stress condition) that is transmitted to the activation volume via the viscoelastic insert medium, which is sufficient to consolidate the green powder blend confined therein. Among the variety of techniques available for pressurizing, two will be described in detail.

Figure 6:
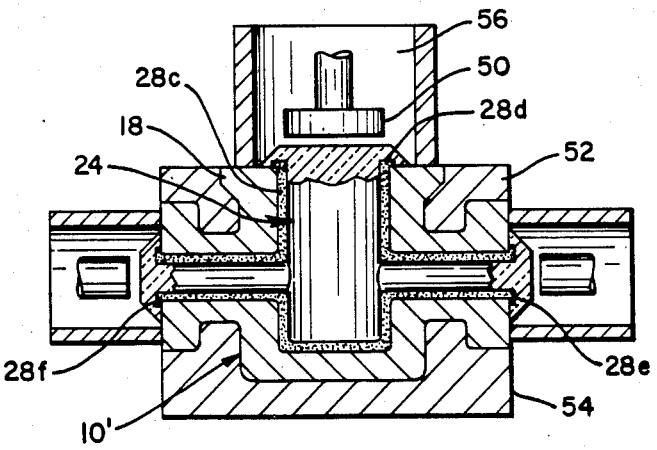
FIG. 6 is a schematic representation of one embodiment of the invention whereby the powder densification is achieved using pressurized rams acting simultaneously or sequentially on the contact surfaces of the preform insert-members to generate a pressure cycle that is transmitted through the insert-members to the activation volume.

The first technique, shown in FIG. 6, utilizes one or more pressurized rams 50, preferably set up the same way as that which was used to manufacture the forged valve body, originally. The die blocks 52, 54 support the exterior of the loaded valve body 10' as the moving rams pressurize the interiors. Especially if metallic capstones 30 are not employed, excessive insert-member extrusion flow out of the cavities while the rams penetrate, can be prevented by a head reservior 56 of heated insert material, which can be provided with appropriate ring-seals if needed to maintain sufficient quantities of insert material for isodynamic compression. Alternatively, capstone heads 30 of variable size and shape can be used for reservoir purposes where required. Although FIG. 6 shows piercing rams 50 entering all valve body cavities at the same time, the central cavity 14 could alternatively be covered with a configured-blocker-plate (not shown) to oppose leakage of insert material, while only the rams that enter the bores are activated to pressurize the valve body cavities. Similarly, the bores could be blocked while the central cavity is rammed, or the rams could be sequenced, or any combination thereof. Preferably, the ram outer diameter lies between the cavity wall inner diameter and the insert member outer diameter, in consideration of the spatial densification factor.

Figure 7:
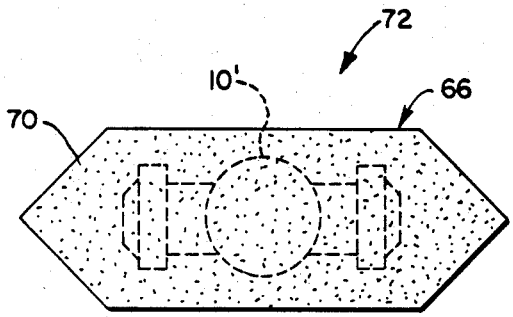
FIG. 7 illustrates another embodiment of this invention where the loaded article is encapsulated within a cured-casing-briquette that is heated prior to the application of densifaction pressures.
Figure 8:
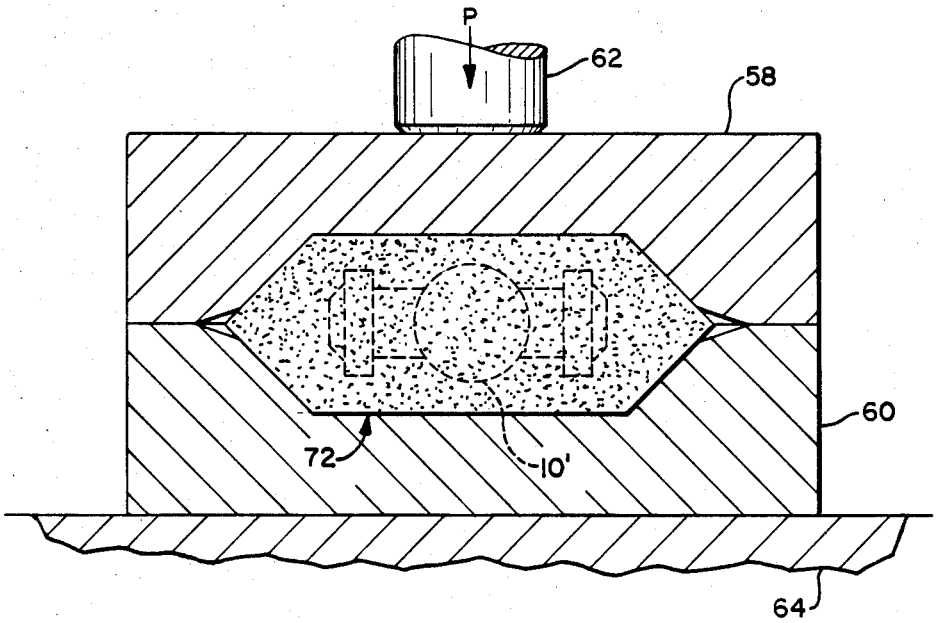
FIG. 8 is a schematic representation of the densification step associated with the embodiment illustrated in FIG. 7, whereby a set of configured pot dies generates a pressure pulse on the briquet, which is transmitted through the bore and central cavity inserts to the activation volume.

In the other embodiment, shown in FIGS. 7 and 8, pot dies 58, 60 and suitable press 62, 64 are used whereby the entire loaded article 10' is subjected to a uniform hydrostatic pressure. This technique includes the steps of immersing or encapsulating the loaded article 10' into a quantity of vitreous material that can be cured or otherwise processed to form a porous isodynamic casing 66 closely conforming internally against the valve body or article 10', and having a smoothly contoured, generally symmetrical outer profile 70. The article 10' is contained within the casing 66 so that their major planes of symmetry are coextensive. For convenience, the cured assembly will be referred to as a briquet 72.

The briquet 72 is then heated to a process temperature T that satisfies the conditions $0.50\ T_{m<T<Tm}$, such that the casing and insert-members become pliable. The hot briquet 72 is immediately placed between a set of pot dies 58, 60 that are contoured 70 to match the shape of the briquet 72 for controlled deformation during isodynamic loading. The press is activated to produce a uniform pressure in the range of (30–200) Ksi and to maintain a dwell time under maximum isodynamic-forming-pressure that varies from about one to ten seconds, depending on the temperature, applied load and equipment that is used. After actuation, compressive loading of the press is transmitted through the viscous casing to the active exterior surfaces 38 of the insert-members and ultimately manifested as a hydrodynamic pressure on the activation volume 28. In this embodiment of the present invention, the press action is described as being perpendicular to the symmetry plane of the loaded article 10' and briquet 72 under a state of pure compressive loading but the process in not restricted to only this type of loading; e.g., compression jigs for tension loading or side rams could be used, if desired. Irrespective of the type loading that is utilized, loads should be applied with respect to symmetrical considerations for part geometry to achieve uniform, efficient pressurization during an optimized pressure-ramp-cycle. Shrinkage or leakage problems for the pressure-transfer-medium are addressed by selective die design; e.g., as in flash-less-forging-die versus closed-die designing.

Since the best mode of the invention assumes that the insert material and/or pressure-transfer-medium be a brittle solid at room temperature, pliant at the process temperature T and sufficiently flowable at the densification pressure P to produce a hydrostatic, hydrodynamic effect at the activation volume region, the recommended material for such specialized application is, generally, a vitreous glass-like substance, and more particularly, a glass or glass mixtural comprising approximately equal parts of crushed glass and mullite (foundry core sand) on a weight basis to which water is added by inspection to create the fluidity that is appropriate for casting preforms or briquets. On a typical basis, water is added to the glass-mullite mix for a volume fraction that does not exceed about 0.33. In the second-described embodiment of this invention or, for modifications thereof, wherein a pot die pressurizes a casing 66 of hot, pliable material in which the loaded article 10' is suspended, the casing is preferably the same composition and volume fraction as that which is used for insert-member. The insert material must be inert with respect to the powder, and at ambient conditions is relatively brittle as compared with the valve body and densified clad material.

It should be appreciated that the present invention is easily implmented for cladding large valves to be used in petroleum or petrochemical applications by the use of a forge press having load capacities in the range of 3000 to 11000 tons, with which hydrostatic pressures suitable for densification at ideal powder compaction temperatures can be achieved. During compression, the applied stress $\sigma_a$ for a specific cladding operation should remain at a magnitude between the ambient yield stress $\sigma_y$ and ultimate stress $\sigma_u$ for the composite structure; e.g., with CRA nickel-base clad on a low-carbon alloy-steel substrate, $\sigma_a/\sigma_y$ or $\sigma_a/\sigma_u$ is about 1.3 with respect to composite strengths. At the same time, process temperature T should be held beyond 0.5 $T_m$ for self-diffusion to continue and, similarly, the elevated temperature flow stress $\sigma_f$ should be associated with a proper ram velocity $\dot{\epsilon}$ of the moving press ram(s) through material constants k and m in accordance with the controlling equation for strain rate sensitivity at process temperature T; viz, $$\sigma_f = k\dot{\epsilon}^m|_T$$

For the case of CRA nickel-bas clad on low-alloy carbon-steel substrates, typical values of $\sigma_a$ and $\sigma_f$ are 120000-Psi and 9000-Psi, respectively.

After the hot isodynamic compression forming, the deformed briquet 72 is extracted from the lower pot die 60 and moved to a still-air area for cooling in normalized manner to ambient temperature. When the casing material 66 and insert-member material 22, 24 have reverted to their brittle state at room temperature, light blows by planish tools are sufficient to extract the clad valve body from its inert and non-reactive glassy confinement. As a final step, the clad vessel is brought within finishing specifications on heat treatment or machining, as required.

It may thus be appreciated that the process and system disclosed herein and claimed hereinbelow provide a convenient technique for cladding with CRA metal powder by consolidating under a suitable press using a hot isodynamic compression at a significant cost savings relative to conventional techniques, such as well-clad or HIP-clad.

I claim:

1. A method for cladding the interior cavity walls of a metal article by a process which utilizes loose metal powder and an inert, vitreous pressure transmitting medium of variable rheological state, comprising the steps of:

(a) forming a solid inert member of said vitreous medium, generally conforming in shape to the cavity walls;

(b) fixturing the insert member within the cavity to provide a generally concentric, annular space of predetermined distance between the insert member and the adjacent walls to be clad, and to expose an exterior surface of the insert member;

(c) sealing the exposed surface of the insert member against the article to form a closed activation volume including said annular space;

(d) selecting a metal powder blend having a known densification temperature-pressure relationship and filling the activation volume to the tap density of said powder blend;

(e) evacuating the activation volume to remove undesired impurities in the blend, and sealing the activation volume to form a loaded article ready for densification from powder to clad;

(f) heating the loaded article to a process temperature T at which the insert member becomes pliable, and which satisfies the condition $0.5\ T_m < T < T_m$ where $T_m$ is the melting temperature of the powder blend;

(g) applying a substantially uniform pressure to the exterior surface of the insert member while at temperature T, to cause a rheological flow of the insert member whereby an isodynamic pressure is applied to said activation volume sufficient to compress and densify the powder blend to form a bonded clad deposit;

(h) cooling the loaded article and removing the insert member from the cavity.

2. The method of claim 1 wherein the step of applying a substantially uniform pressure is carried out in the range of between about 30–200 Ksi for a dwell time of between about 1 to 10 seconds.

3. The method of in claim 2 where the temperature T is sufficient to soften the powder blend and produce self-diffusion therein.

4. The method of in claim 2 where the step of forming a solid insert member further includes forming capstones thereon and the step of sealing the exposed surface of the insert member includes sealing said capstones against the article.

5. The method of claim 2 wherein the step of applying a uniform pressure causes the insert member to become sufficiently plastic to transmit said pressure hydrodynamically.

6. The method of claim 1 wherein the step of applying a substantially uniform pressure includes the steps of supporting the loaded article in die blocks while piercing rams are pressed against the exposed exterior surface of the insert members, to generate the isodynamic pressure pulse.

7. The method of claim 1 wherein the step of applying a substantially uniform pressure includes the steps of encapsulating the loaded article in a quantity of vitreous material having substantially the same properties as the insert medium, to form a briquet; placing the briquet between a set of configured pot dies contoured to match the shape of the briquet, and pressing the pot dies together to generate the required pressure.

8. A method for cladding selected interior cavity walls of a flanged valve body, by a process which utilizes loose metal powder and an inert, vitreous transmitting medium of variable rheological state, comprising the steps of:

(a) cleaning the cavity walls;

(b) forming a solid insert member of said vitreous medium, generally conforming in shape to the cavity walls;

(c) fixturing the insert member within the cavity to provide a generally concentric annular space of predetermined distance between the insert member and its adjacent walls to be clad, and to expose an exterior surface of the insert member;

(d) inserting fill and seal tubes into the annular space;

(e) sealing the exposed surface of the insert member against the valve body flanges to form a closed activation volume including said annular space;

(f) selecting a metal powder blend having a known densification temperature-pressure relationship and filling the activation volume through the fill tubes to the tap density of said powder blend;

(g) evacuating the activation volume to remove undesired impurities in the blend, and sealing said tubes to form a loaded article ready for densification from powder to clad;

(h) heating the loaded article to a temperature T at which the insert member becomes pliable, and which satisfies the condition $0.5\ T_m<T<T_m$ where $T_m$ is the melting temperature of the blend;

(i) while the loaded article is at temperature T, applying a substantially uniform pressure to the exterior surface of the insert member to cause a rheological flow of the insert member whereby an isodynamic pressure is applied to said activation volume sufficient to compress and densify the powder blend to form a clad deposit metallurgically bonded to the selected cavity walls;

(j) cooling the loaded article until the insert member reverts to its ambient temperature and pressure condition as a relatively brittle solid;

(k) removing the insert member from the cavity of the clad valve body.

9. The method of claim 8 wherein the step of forming a solid insert member further includes forming at least one thin metal capstone adapted to abut said flanges, and said step of sealing the exposed surface of the insert member includes sealing the capstone to said flange.

10. A system for densifying metal powder to produce clad valve interiors, comprising:

(a) a valve body having intersecting interior cavities, at least one of which is to be clad;

(b) a solid, inert, vitreous insert member located within each cavity and connected to the other members at the intersection, each insert member in a cavity to be clad being uniformly spaced from the adjacent cavity wall to form an activation volume therebetween, and each insert in a cavity not to be clad occupying substantially all its respective cavity, all of said inserts having an external surface sealed to the valve exterior;

(e) the vitreous insert member material having a rheological characteristic such that, i. at ambient temperature and pressure the material is brittle relative to the valve, ii. at a process temperature T and ambient pressure the material is pliable, iii. at a process temperature T and process pressure P the material is capable of transmitting pressure hydrodynamically, and iv. wherein T satisfies the condition $0.5\ T_m<T<T_m$, $T_m$ being the melting temperature of the metal powder, and P is in the range of 30–200 Ksi;

(d) a quantity of clean metal powder filling said activation volume at substantially tap density under a partial vacuum;

(e) means for raising the temperature of the valve body with inserts therein to said process temperature T; and (f) means for mounting and supporting the valve body while at process temperature T, and applying a pressure pulse substantially simultaneously to the external surface of at least one insert member, sufficient for said insert material to hydrodynamically transmit said pulse to the activation volume, whereby the powder metal is densified and bonded to the adjacent cavity wall.

11. The system of claim 10 wherein the insert members include capstones sealed to the valve body exterior and defining a portion of said activation volume.

12. The system of claim 10 wherein said means for mounting and supporting the valve body and applying a pressure pulse, include, (a) a pair of die blocks supporting the exterior of the valve body; and (b) at least one ram oriented to move along the axis of a cavity and adapted to penetrate said cavity.

13. The system of claim 10 wherein said means for mounting and supporting the valve body and applying a pressure include, (a) a vitreous casing encapsulating the valve body and having a smoothly contoured, generally symetrical outer profile, said casing having a variable rheological state such that at the process temperature T the casing is pliable;

(b) a set of pot dies configured around the casing and having a contoured surface matching the contour of the casing; and (c) means for compressive loading of the dies for transmitting the process pressure pulse through the casing to the exterior surfaces of the insert members.

14. the system of claim 13 wherein the pressing action of the dies is perpendicular to the symmetry plane of the valve body.

* * * * *